US006572099B2

(12) United States Patent
Gunschera et al.

(10) Patent No.: US 6,572,099 B2
(45) Date of Patent: Jun. 3, 2003

(54) DEVICE FOR HOLDING SHEETS HIGH

(75) Inventors: Frank Gunschera, Nussloch (DE); Sven Kerpe, Eggenstein-Leopoldshafen (DE); Uwe Fischer, Leimen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 209 days.

(21) Appl. No.: 09/732,983

(22) Filed: Dec. 8, 2000

(65) Prior Publication Data

US 2001/0020766 A1 Sep. 13, 2001

(30) Foreign Application Priority Data

Dec. 8, 1999 (DE) ..... 199 59 099

(51) Int. Cl.[7] ..... B65H 29/34
(52) U.S. Cl. ..... 271/188
(58) Field of Search ..... 271/188, 189, 271/209, 214

(56) References Cited

U.S. PATENT DOCUMENTS

| | | | | |
|---|---|---|---|---|
| 3,933,352 A | * | 1/1976 | Sinn | 271/189 |
| 4,983,096 A | | 1/1991 | Bodewein | |
| 5,102,117 A | * | 4/1992 | Henn et al. | 271/189 |
| 5,131,647 A | * | 7/1992 | Henn et al. | 271/183 |
| 5,697,605 A | | 12/1997 | Pollich et al. | |
| 5,769,413 A | | 6/1998 | Hummel et al. | |

FOREIGN PATENT DOCUMENTS

| | | |
|---|---|---|
| DE | 9369 | 3/1955 |
| DE | 38 23 806 A1 | 1/1990 |
| DE | 40 11 286 A1 | 10/1991 |
| DE | 195 07 370 A1 | 9/1996 |
| EP | 0 790 206 A1 | 8/1997 |

* cited by examiner

*Primary Examiner*—Donald P. Walsh
*Assistant Examiner*—Kenneth W. Bower
(74) *Attorney, Agent, or Firm*—Laurence A. Greenberg; Werner H. Stemer; Ralph E. Locher

(57) ABSTRACT

A device for holding sheets high in order to form gaps between sheets, during operation of a sheet pile-forming sheet-processing machine, includes vertically adjustable sheet interceptors for holding sheets high. The sheet interceptors being movable into a front pile-forming region so as to penetrate a depth therein which is so small that the sheet interceptors do not come into contact with a printed region of a sheet resting on the sheet interceptors; a sheet processing machine including the holding device; and a sheet-fed printing machine including the holding device.

5 Claims, 1 Drawing Sheet

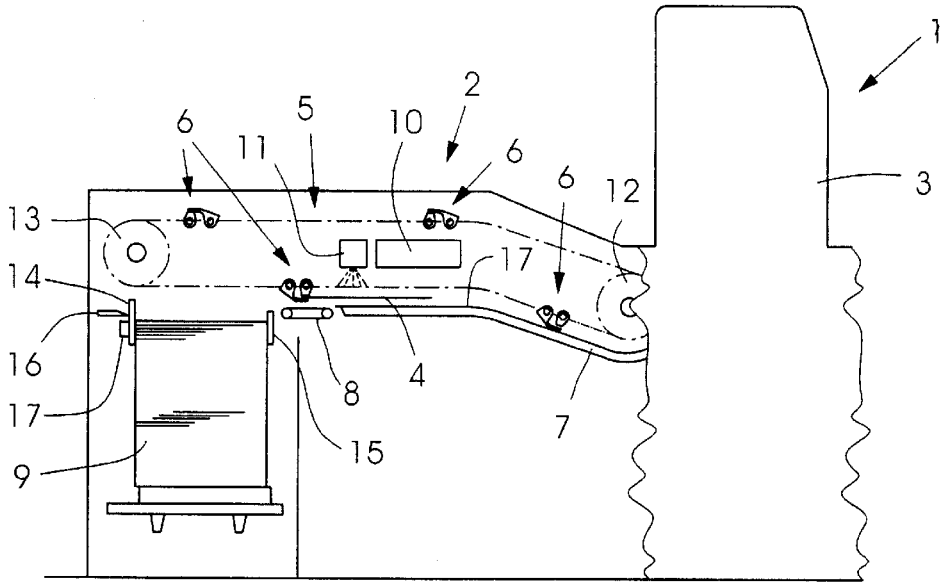
Fig.1
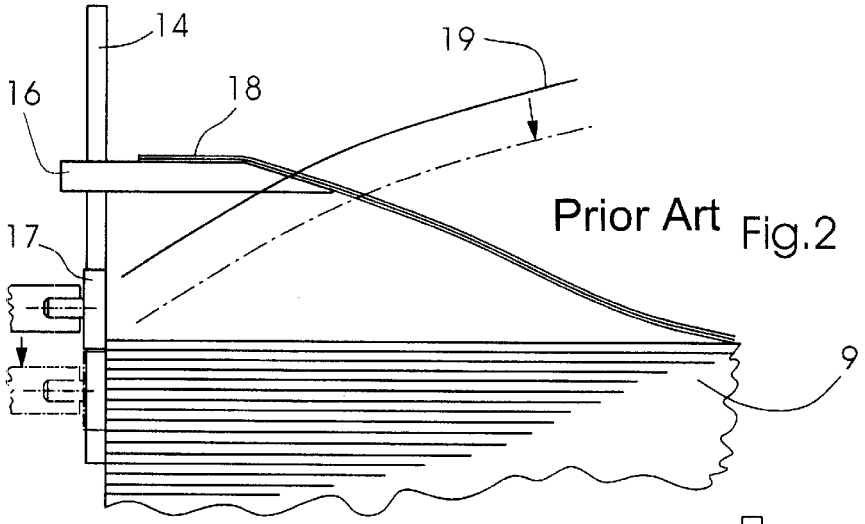
Prior Art Fig.2
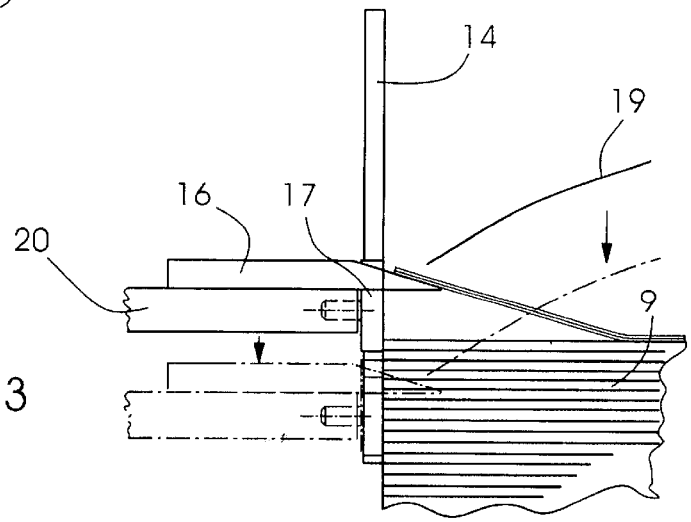
Fig.3

DEVICE FOR HOLDING SHEETS HIGH

BACKGROUND OF THE INVENTION

Field of the Invention

The invention relates to a device for holding sheets high in order to form gaps during operation of a pile-forming sheet-processing machine, in particular a sheet-fed printing machine.

In a pile-forming machine, the sheet pile that is produced has to be removed from time to time. Furthermore, in order for the printed image to be assessed, sample sheets have to be drawn out at regular intervals. In a continually operating machine, this should take place during operation as far as possible without disrupting production and without damaging sheets.

For this purpose, prior to the removal of a finished pile or of individual sample sheets, sheet interceptors, such as are described in the published German Patent Document DE 40 11 286 C2, are moved from the front, from between the front sheet stops, into the pile-forming region, with the result that the leading edge of the succeeding sheet, rather than dropping down onto the pile, is held high by the sheet interceptors. The gap which is thus kept open at the front side of the pile can then be utilized for removing a sample sheet or for sliding in an auxiliary pile carrier for pile-changing purposes.

In order to stabilize the free fall of the sheets as they are deposited on the pile, it is possible for the sheet falling height between the sheet brake, which brakes the sheets before they are deposited on the pile, and the top edge of the pile to be set by vertical adjustment of a sensor which registers the top pile edge and is linked to a lifting-control device for the pile base. In order for the sheets to be restrained reliably, in particular, in the case of great sheet-falling heights, the sheet interceptors are provided with a given minimum length by which they project into the pile-forming region. The printed image on the underside of the sheet is thereby damaged. Furthermore, the succeeding sheets make contact with the printed region of the preceding sheet and scratch the printed image thereof at the upper side. In the case of a very great falling height, however, the sheets are not reliably restrained by the sheet interceptors.

SUMMARY OF THE INVENTION

It is accordingly an object of the invention to provide a device for holding a sheet high, of the type mentioned in the introduction hereto which operates reliably for every sheet falling height, and helps to avoid scratching of the sheets. With the foregoing and other objects in view, there is provided, in accordance with one aspect of the invention, a device for holding sheets high in order to form gaps between sheets during operation of a sheet pile-forming sheet-processing machine, comprising vertically adjustable sheet interceptors for holding sheets high, the sheet interceptors being movable into a front pile-forming region so as to penetrate a depth therein which is so small that the sheet interceptors do not come into contact with a printed region of a sheet resting on the sheet interceptors.

In accordance with another feature of the invention, the holding device includes a common mounting support for the sheet interceptors and a sensor for registering a top edge of a sheet pile, the sheet interceptors and the sensor being arranged so that they are fixed relative to one another on the common mounting support, and the common mounting support being vertically adjustable as a whole.

In accordance with a further feature of the invention, the holding device includes front sheet stops also arranged on the common mounting support.

In accordance with an added feature of the invention, spacing of the sheet interceptors and the sensor relative to one another on the common mounting support is alterable for purposes of precision-adjustment.

In accordance with another aspect of the invention, there is provided a sheet-processing machine having a device for holding sheets high in order to form gaps between sheets during continuing operation of the machine, comprising vertically adjustable sheet interceptors for holding sheets high, the sheet interceptors being movable into a front pile-forming region so as to penetrate a depth therein which is so small that the sheet interceptors do not come into contact with a printed region of a sheet resting on the sheet interceptors.

In accordance with a concomitant aspect of the invention, there is provided a sheet-fed printing machine having a device for holding sheets high in order to form gaps between sheets during continuing operation of the printing machine, comprising vertically adjustable sheet interceptors for holding sheets high, the sheet interceptors being movable into a front pile-forming region so as to penetrate a depth therein which is so small that the sheet interceptors do not come into contact with a printed region of a sheet resting on the sheet interceptors.

By setting the sheet interceptors to the sheet fall height, the relative spacing between the sheet interceptors and the top pile edge can be kept constant. It is thus possible for the penetration depth of the sheet interceptors to be much smaller than when the latter are arranged in a fixedly predetermined manner.

By setting the sheet interceptors so that they penetrate into the pile-forming region just above the pile surface, reliable interception of the sheets is ensured, despite the small penetration depth, and the deformation of the high-held sheets is kept to a very low level. This avoids a situation wherein the sheets are damaged by buckling.

Separate readjustment of the sheet interceptors may be dispensed with if the sheet interceptors and a sensor which registers the top pile edge are arranged so that they are fixed relative to one another on a common mounting support which can be adjusted vertically as a whole.

Provision may thus be made for the front sheet stops likewise also to be arranged on the common mounting support.

For precise adjustment of the sheet interceptors, provision may be made for altering the spacing of the sheet interceptors and the sensor relative to one another on the common mounting support, for the purposes of precision-adjustment.

A sheet processing machine and a sheet-fed printing machine, respectively, which are equipped with the sheet interceptors according to the invention also form parts of the invention.

Other features which are considered as characteristic for the invention are set forth in the appended claims.

Although the invention is illustrated and described herein as embodied in a device for holding sheets high, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 1 is a fragmentary diagrammatic side elevational view of a sheet-fed printing machine incorporating a sheet high-holding device according to the invention;

FIG. 2 is an enlarged fragmentary view of FIG. 1, but showing a sheet high-holding device with a pushed or slid-in sheet interceptor according to the prior art; and FIG. 3 is an enlarged fragmentary view of FIG. 1, showing a sheet high-holding device with a pushed or slid-in sheet interceptor according to the invention.

Like parts in all of the figures are identified by the same reference numerals.

DESCRIPTION OF THE PREFERRED EMBODIMENTS

Referring now to the drawings and, first, particularly to FIG. 1 thereof, there is shown therein, in a sheet-fed printing machine 1, a delivery 2 adjoining a last printing unit 3. Printed sheets 4 are picked up from the last printing unit 3 by gripper bars 6, and more specifically by grippers thereof, the gripper bars 6 being fastened on chains 5, shown only in phantom here, and transported, via a sheet-guiding device 7 and a sheet brake 8, onto a pile 9 and deposited thereon. In order to avoid a situation wherein the sheets are deposited on the pile 9 and stick together, the sheets are guided beneath a drier 10 and a powder sprayer 11.

A respective chain 5 runs over a drive gearwheel 12 and a deflecting region 13. The gripper bars 6 are guided by the chains 5 via non-illustrated chain-guide paths.

A sheet which is to be deposited is drawn by the gripper bars 6 onto the sheet brake 8, which includes a suction belt revolving, in the example at hand, at the depositing speed, and is secured by suction through the suction belt. After the release of the sheet 4 from the gripper bars 6, the sheet 4 is braked and, finally, slides against a front sheet stop 14 and drops by the trailing edge thereof down onto the pile 9 past a rear sheet stop 15. In this regard, in order to compensate for the increase in height, the pile 9 is moved downwards. The top edge of the pile 9 is monitored by a vertically adjustable sensor 17. The height of the top pile edge set by the sensor 17 is adjusted accordingly, via a control system, by a lifting table whereon the pile is located.

In order to remove a sheet during operation of the machine, as FIG. 2 shows, once a sheet has dropped down, sheet interceptors 16 are pushed or slid into the pile-forming region from the front. The succeeding sheets 4 remain suspended by the leading edge thereof on the sheet interceptors 16 and are held high. A sample sheet may then be removed out of the gap that has been formed. In order to remove the entire pile 9, it is also possible to push or slide into the gap a non-illustrated auxiliary pile carrier bearing a new sheet pile 18.

A sheet fall line 19 is illustrated in FIGS. 2 and 3, respectively, in a high position, represented by a solid line, and a low position, represented in phantom or by a dot-dash line. The high position corresponds to a slight fall height of the sheet and the low position, the reverse. It is believed to be apparent from FIG. 2 that a vertically non-adjustable sheet interceptor 16 has to project into the pile-forming region to a very great extent in order that it also be possible for sheets with a great fall height yet to be intercepted reliably. As a result, the sheet interceptors 16 project into the printed region of the sheet, if the latter is printed on the underside thereof, and scratch the print. In the illustrated configuration, it is even possible, in the case of a great fall height, for the sheet not to be intercepted at all.

In FIG. 3, by contrast, the sheet interceptors 16 are fastened, together with the pile sensor 17, on a common crossmember or mounting support 20. The sheet interceptor 16 is vertically adjustable together with the sensor 17, so that the spacing thereof relative to one another is always optimal. In order to be able to intercept every sheet reliably from any fall height, it is sufficient, then, for the sheet interceptors 16 to project only a slight distance into the pile-forming region. Damage to the printed region of the sheet is thereby avoided.

We claim:

1. A device for holding up sheets in order to form a gap between sheets while stacking a sheet pile of the sheets in a sheet pile-forming sheet-processing machine, comprising sheet interceptors for holding up the sheets, said sheet interceptors being movable into a front pile-forming region so as to penetrate a depth therein being small enough to prevent said sheet interceptors from coming into contact with a printed region of a sheet resting on said sheet interceptors, a sensor for registering a top edge of the sheet pile and a common mounting support for said sheet interceptors and said sensor, said common mounting support being vertically adjustable.

2. The holding device according to claim 1, including front sheet stops also arranged on said common mounting support.

3. The holding device according to claim 1, wherein spacing of said sheet interceptors and said sensor relative to one another on said common mounting support is alterable for purposes of precision-adjustment.

4. A sheet-processing machine having a device for holding up sheets in order to form a gap between sheets while stacking a sheet pile of the sheets in the machine, comprising sheet interceptors for holding up the sheets, said sheet interceptors being movable into a front pile-forming region so as to penetrate a depth therein being small enough to prevent said sheet interceptors from coming into contact with a printed region of a sheet resting on said sheet interceptors, a sensor for registering a top edge of the sheet pile and a common mounting support for said sheet interceptors and said sensor, said common mounting support being vertically adjustable.

5. A sheet-fed printing machine having a device for holding up sheets in order to form a gap between sheets while stacking a sheet pile of the sheets in the machine, comprising sheet interceptors for holding up the sheets, said sheet interceptors being movable into a front pile-forming region so as to penetrate a depth therein being small enough to prevent said sheet interceptors from coming into contact with a printed region of a sheet resting on said sheet interceptors, a sensor for registering a top edge of the sheet pile and a common mounting support for said sheet interceptors and said sensor, said common mounting support being vertically adjustable.

* * * * *